US008899046B2

(12) United States Patent
Van Der Werff

(10) Patent No.: US 8,899,046 B2
(45) Date of Patent: Dec. 2, 2014

(54) METHOD OF CONVERTING THERMAL ENERGY INTO MECHANICAL ENERGY, AND AN APPARATUS

(75) Inventor: Jeichienus Adriaan Van Der Werff, Montfoort (NL)

(73) Assignee: Cyclo Dynamics B.V., Montfoort (NL)

( * ) Notice: Subject to any disclaimer, the term of this patent is extended or adjusted under 35 U.S.C. 154(b) by 205 days.

(21) Appl. No.: 13/697,834

(22) PCT Filed: Nov. 19, 2010

(86) PCT No.: PCT/NL2010/000164

§ 371 (c)(1),
(2), (4) Date: Nov. 14, 2012

(87) PCT Pub. No.: WO2011/159145

PCT Pub. Date: Dec. 22, 2011

(65) Prior Publication Data

US 2013/0074500 A1 Mar. 28, 2013

(30) Foreign Application Priority Data

Jun. 18, 2010 (NL) ..... PCT/NL2010/000098

(51) Int. Cl.
*F01K 25/02* (2006.01)

(52) U.S. Cl.
CPC ..... *F01K 25/02* (2013.01)
USPC ..... 60/650

(58) Field of Classification Search
CPC ..... F01K 25/02; F03G 7/06
USPC ..... 60/650, 645, 655, 682, 660, 641.1
See application file for complete search history.

(56) References Cited

U.S. PATENT DOCUMENTS

| | | | | |
|---|---|---|---|---|
| 4,183,220 | A | 1/1980 | Shaw | |
| 4,222,239 | A * | 9/1980 | Negishi | 60/527 |
| 4,283,915 | A | 8/1981 | McConnell et al. | |

(Continued)

FOREIGN PATENT DOCUMENTS

| | | | |
|---|---|---|---|
| GB | 1454505 | A | 11/1976 |
| WO | 9830786 | A1 | 7/1998 |
| WO | 2009082773 | A2 | 7/2009 |

*Primary Examiner* — Thomas Denion
*Assistant Examiner* — Shafiq Mian
(74) *Attorney, Agent, or Firm* — Shewchuk IP Services, LLC; Jeffrey D. Shewchuk

(57) ABSTRACT

The present invention relates to a method of converting thermal energy into mechanical energy using a non-gaseous working medium present in an apparatus comprising a plurality of heat exchangers and an outgoing shaft. In accordance with the invention, the apparatus used comprises a multitude of chamber units, a chamber unit comprising an inlet for introducing heat exchange medium and an outlet for discharging heat exchange medium as well as a closed chamber having a heat exchanger wall for exchanging heat between working medium inside the closed chamber and the heat exchange medium introduced into the chamber unit via said inlet for introducing heat exchange medium and heat exchange medium is passed around so as to do work when it is giving off heat to a chamber unit containing relatively cool working medium and recuperate heat when it is passed through a chamber unit containing relatively warm working medium. The invention also relates to an apparatus for performing the method.

15 Claims, 11 Drawing Sheets

(56) References Cited

U.S. PATENT DOCUMENTS

| | | | | |
|---|---|---|---|---|
| 4,637,211 | A | 1/1987 | White et al. | |
| 5,025,627 | A * | 6/1991 | Schneider | 60/527 |
| 5,321,946 | A | 6/1994 | Abdelmalek | |
| 5,916,140 | A | 6/1999 | Hageman | |
| 6,178,750 | B1 * | 1/2001 | van der Werff et al. | 60/650 |
| 2003/0033806 | A1 * | 2/2003 | Bittner | 60/675 |
| 2007/0169481 | A1 * | 7/2007 | Xu | 60/650 |
| 2010/0287929 | A1 * | 11/2010 | Loidl | 60/524 |

* cited by examiner

METHOD OF CONVERTING THERMAL ENERGY INTO MECHANICAL ENERGY, AND AN APPARATUS

The present invention relates to a method of converting thermal energy into mechanical energy using a non-gaseous working medium present in an apparatus comprising a plurality of heat exchangers and an outgoing shaft.

There is an enormous drive to use energy as well as possible, both for economical and environmental reasons. Low-grade heat is available in large quantities, be it waste heat from industrial processes or other sources, or by generating it using solar energy. Unfortunately, most in demand is high-grade energy, such as mechanical energy which can be converted into electricity, which is even more in demand. WO9830786 (PCT/NL98/00012) discloses a method and an apparatus for converting thermal energy into mechanical energy. It makes use of paraffin as a working medium. Paraffin is a substance that over a (limited) temperature range displays superexpansion, that is an expansion of >0.01% per ° C. A typical value for the coefficient of expansion of paraffin is 0.05% per ° C., and in a more limited range even as high as >0.2% per ° C. By selecting the working medium with the upper end of the superexpansion range near the temperature of the heating heat exchange medium, it is possible to convert the heat of the heating heat exchange medium efficiently. Alternatively, it may be possible to change the temperature of the heating heat exchange medium to match the working medium present in the apparatus.

The apparatus disclosed in WO9830786 is susceptible to problems with sealing of the working medium, in particular at high pressures of the working medium (which may well be at 200 bar or higher), making the method less reliable.

The object of the present invention is to provide a method according to the preamble with reduced susceptibility to working medium sealing problems.

To this end, the invention according to the preamble is characterized in that the apparatus comprises a multitude of chamber units, a chamber unit comprising an inlet for introducing heat exchange medium and an outlet for discharging heat exchange medium as well as a closed chamber having a heat exchanger wall for exchanging heat between working medium inside the closed chamber and the heat exchange medium introduced into the chamber unit via said inlet for introducing heat exchange medium;

the closed chambers of the chamber units comprise a cylinder and a piston, wherein the piston of a closed chamber is workably connected to the outgoing shaft, the outgoing shaft being workably driven by the piston if the piston is moved from a first, relatively retracted position in the cylinder to a second, relatively protruding position and free movement of the outgoing shaft is allowed if said piston is moved from the second to the first position;

wherein heat exchange medium having a first, high temperature is used for heating working medium present in a first chamber unit for driving the outgoing shaft;

heat exchange medium having a second, low temperature is used for cooling working medium in a second chamber unit;

relatively cool heat exchange medium having a third temperature between the first and the second temperature is introduced via the inlet of a third chamber unit comprising relatively warm working medium to yield warmed-up heat exchange medium;

relatively warm heat exchange medium having a fourth temperature between the first and the second temperature is introduced via the inlet of a fourth chamber unit comprising relatively cool working medium to heat the working medium and drive the outgoing shaft;

wherein after being heated by the heat exchange medium of the first temperature, the first chamber unit is used as a third chamber unit so as to extract thermal energy from said third chamber unit to result in warmed-up heat exchange medium;

after being cooled by the heat exchange medium of the second temperature, the second chamber unit is used as a fourth chamber unit to be warmed by relatively warm heat exchange medium of a fourth temperature;

after being cooled down by relatively cool heat exchange medium of a third temperature, the third chamber unit is used as a second chamber unit; and after being warmed by relatively warm heat exchange medium of a fourth temperature the fourth chamber unit is used as the first chamber unit.

This eliminates the need for moving working medium under high pressure from one chamber to another, thus significantly reducing the sealing problem. Thus, after a personal quest of over two decades, a method is provided that allows for both reliable and efficient conversion of thermal energy into mechanical energy for increased periods of time thanks to improved sealing. In the present application, the term "heat exchange medium" refers to any of heat exchange medium of the first, second, third and fourth temperature for exchange of heat with the working medium, but not to the working medium itself. The heat exchange medium will generally be water. Depending of its location in the apparatus, the heat exchange medium serves as a cooling medium or a heating medium. The working medium is capable of flowing, at least at the upper end of the superexpansion range, and will generally be a liquid, including also suspensions and pastes. The term "outgoing shaft" means a shaft indirectly driven by expanding working medium. The outgoing shaft may be a shaft capable of reciprocating movement and/or a rotary movement. The adjectives "high" and "low" used in conjunction with temperature are relative, not absolute terms. The temperatures of relatively cool heat exchange medium of the third temperature and relatively warm heat exchange medium of the fourth temperature are somewhere between these high and low temperatures, and are relative to the temperature of working medium in the chamber unit the heat exchange medium is passing through and not relative to each other. In the method according to the invention, there will usually be at least two third chamber units between the first and the second chamber unit to extract as much thermal energy from the working medium in the third chamber units. Also, there will usually be at least two fourth chamber units between the second and the first chamber unit to transfer as much thermal energy from the working medium in the fourth chamber units. The use of multiple fourth chamber units contributes to a (mechanically) smooth operation.

According to a preferred embodiment, there is at least one pair of fourth chamber units, the first of the pair of fourth chamber units comprising working medium at a relatively high temperature compared to the temperature of the working medium in the second of said pair of fourth chamber units, wherein the second of said pair of fourth chamber units is heated using heat exchange medium discharged from the first chamber unit after heat exchange with said first chamber unit; and the first of said pair of fourth chamber units is heated using relatively warm heat exchange medium discharged from a third chamber unit that has a temperature of the working medium closest to the temperature of the working medium of the first chamber unit.

This provides for a relatively large temperature difference between heat exchange medium and working medium, allowing the pistons to do a lot of work. This manner of operation is in particular advantageous if the thermal energy content of the heat exchange medium with respect to the temperature of the heat exchange medium of the second temperature is to be converted, as will be explained in more detail in the example section.

According to a preferred embodiment, there is at least a second pair of fourth chamber units, the first chamber unit of said second pair of fourth chamber units comprising working medium at a relatively high temperature compared to the temperature of the working medium in the second chamber unit of said second pair of fourth chamber units, and cooled down heat exchange medium from the first chamber unit of the pair of fourth chamber units is used to heat the first chamber unit of said second pair of fourth chamber units and cooled down heat exchange medium from the second chamber unit of the first pair of fourth chamber units is used to heat the second chamber unit of said second pair of fourth chamber units.

Despite the relatively large temperature difference between heat exchange medium and working medium, heat energy is converted to a larger extent into mechanical energy.

According to a preferred embodiment, cooled-down heat exchange medium from the first chamber unit of the last pair of fourth chamber units is discharged from the apparatus and the loss of heat exchange medium being compensated by the heat exchange medium having the first temperature introduced in the first chamber unit; and cooled-down heat exchange medium from the second chamber unit of the last pair of fourth chamber units is used as relatively cool heat exchange medium to cool working medium in a third chamber unit having a working medium temperature closest to the working temperature of the second chamber unit.

This method allows for the most extensive conversion of heat from the heating heat exchange medium to mechanical energy. If the apparatus comprises a multitude of third chamber units, as will generally be the case, the cooled-down heat exchange medium from the first chamber of the last pair of fourth chamber unit will be used as relatively cool heat exchange medium to extract heat from the working medium present in the third chamber unit having the lowest temperature.

According to a preferred embodiment, the outgoing shaft is connected to a generator for generating electricity.

Thus very high-grade energy is obtained.

According to a preferred embodiment, the apparatus comprises a second working medium, the working medium and the second working medium differing in super expansion range.

This allows the apparatus to be used with a broader temperature range of heating heat exchange medium. The super expansion ranges of the working medium and the second working medium are different, but may still overlap. The different working media may be different waxes, such as different paraffins. It is feasible to have a single closed chamber contain different working media, for example if they are separated from each other by a second free moving piston. Alternatively, there are groups of two (or more) chamber units each group operated as described for a single chamber unit in the method according to the invention, the two (or more) chamber units of a group having different working media.

According to a preferred embodiment, the heat exchange medium is heated using solar energy.

This is a very important application of the method according to the present invention. Sunlight can be converted into heat using a solar collector very efficiently, and subsequently converted using the method according to the present invention quite efficiently. Another major advantage is that heat can be stored in a buffer, be it daily or for longer periods, such that mechanical energy but more importantly electricity can be generated even when no sunlight is available. Obviously this is not possible with (expensive) solar panels.

Finally, the present invention relates to an apparatus for converting thermal energy into mechanical energy using a non-gaseous working medium, the apparatus comprising a plurality of heat exchangers and an outgoing shaft, wherein the apparatus comprises a multitude of chamber units, a chamber unit comprising an inlet for introducing heat exchange medium and an outlet for discharging said heat exchange medium after having undergone heat exchange as well as a closed chamber having a heat exchanger wall for exchanging heat between working medium inside the closed chamber and the heat exchange medium introduced into the chamber unit via said inlet for introducing heat exchange medium;

the closed chambers comprising a cylinder and a piston, the piston of a closed chamber being workably connected to the outgoing shaft via an organ capable of driving the outgoing shaft if the piston is moved from a first, relatively retracted position in the cylinder to a second, relatively protruding position for driving the outgoing shaft and allowing free movement of the outgoing shaft if said piston is moved from the second to the first position;

the apparatus comprises a device for distributing a heat exchange medium for passing said heat exchange medium along the heat exchanger walls via said inlets and outlets of the chamber units, the device being capable of providing a first chamber unit with heat exchange medium of a first high temperature and providing a second chamber unit with heat exchange medium with a second low temperature, providing a third chamber unit with heat exchange medium of a third temperature between the first and the second temperature and providing a fourth chamber unit with heat exchange medium of a fourth temperature between the first and the second temperature.

Thus an apparatus has been provided that allows for the reliable and efficient conversion of thermal energy into mechanical energy for increased periods of time thanks to improved sealing. In practice, the chamber units of an apparatus according to the invention will be quite similar such as identical. The heat exchanger wall is generally part of a tube having a circular cross-section so as to withstand the forces that occur during operation when the working medium expands. The walls of the closed chamber are sufficiently rigid to ensure that pressure developing inside the closed chamber results in the piston being moved from a first retracted position to a second, extended position. Paraffin is a preferred working medium because its composition can be changed to suit the temperature of the heating heat exchange medium.

According to a preferred embodiment, the outgoing shaft is connected to a generator for generating electricity.

Thus very high-grade energy is obtained.

According to a preferred embodiment, the apparatus comprises a control device for starting and stopping the flow of heat exchange medium through at least one of the chamber units.

The control device will be operated such that the flow of heat exchange medium is interrupted while the flow of heat exchange medium is switched between chamber unites. This makes the device for distributing heating heat exchange medium and cooling heat exchange medium less susceptible to leakage of heat exchange medium. As an alternative solution, a by-pass could be used but depending on the circumstances, this could result in a waste of thermal energy.

According to a preferred embodiment, the organ comprises a freewheel.

This allows for a convenient conversion of the reciprocating motion of a piston to a rotary motion of the shaft.

According to a preferred embodiment, the piston of a chamber unit is provided with a sprocket, the apparatus comprises a frame and a chain, a first end of the chain being attached to the frame and the chain from that first end being passed over said sprocket and subsequently over the freewheel.

When the piston moves from the first relatively retracted position in the cylinder to a second, relatively protruding position, the sprocket is pushed away from the cylinder, and the freewheel starts to drive the outgoing axis. If the chamber is cooled, the working medium contracts and the piston moves from the second, relatively protruding position to the first relatively retracted position in the cylinder. Then, the freewheel will move freely in the opposite direction and no work is done by the piston. The chain will be a heavy duty chain, such as of a motorcycle.

According to a preferred embodiment, the piston of a third chamber unit is aligned opposite to a piston of a fourth chamber unit, the second, remaining end of the chain being attached to the frame as well and the third and fourth chamber units each having their own sprocket and freewheel but sharing the chain, the apparatus being provided with a tensioning organ for keeping the chain taut.

The use of such a chain differential allows the number of tensioning organs to be reduced. The difference in phase for the opposite chamber units is preferably 180°. The tensioning organ may comprise a rubber band, a coil spring or any other means. The tensioning organ will be elongated in the process.

According to a preferred embodiment, the device for distributing heat exchange medium over chamber units comprises a first member and a second member, the first member being rotatable relative to the second member around an axis of rotation in a first direction, the first member comprising a multitude of through channels, each of these through channels connecting two surface areas of said first member and suitable for passing heat exchange medium to and from chamber units and the second member comprising a conduit arrangement, wherein for every chamber unit of the multitude of chamber units the first member comprises at least a first channel for passing heat exchange medium to a chamber unit and at least one second channel for heat exchange medium passed through said chamber unit; the first channel having an inlet end facing the second member and an outlet end not facing the second member; the second channel having an outlet end facing the second member and an inlet end not facing the second member, the inlet ends of the first channels being distributed evenly spaced over the circumference of a circle having its center on the axis of rotation and the outlet ends of the second channels being distributed evenly spaced over the circumference of a second circle having its center on the axis of rotation;

the conduit arrangement of the second member comprises a multitude of through channels, the through channels having inlets for sealingly connecting to the outlets of second channels of the first member and to an inlet for heat exchange medium of the first high temperature and to an inlet for heat exchange medium of a second low temperature, and outlets for sealingly connecting to the inlets of first channels of the first member, and an outlet for discharging heat exchange medium from the apparatus;

said inlets of the second member being distributed over the first circle and said outlets of the second member being distributed over the second circle, and the through channel of the second member being capable of connecting the outlet of a second channel of the first member connected to a particular chamber unit with the inlet of a first channel of the first member connected to a different chamber unit.

The second member determines the path that the heat exchange medium should take to pass through the various chamber units. The term "evenly spaced" allows for deviations as long as the relative rotation results in the desired channels being connected without leakage of heat exchange medium. The first and second circle may have the same radius (as exemplified in the example discussed below).

The invention will now be explained in more detail with reference to the following drawings:

FIG. 1*a* shows in a cut-away view a chamber unit suitable for use in the method and in an apparatus according to the invention;

FIG. 1*b* shows a bottom view of the chamber unit of FIG. 1*a;*

FIG. 2 depicts a graph to illustrate super expansion of a working medium;

Figure 5:
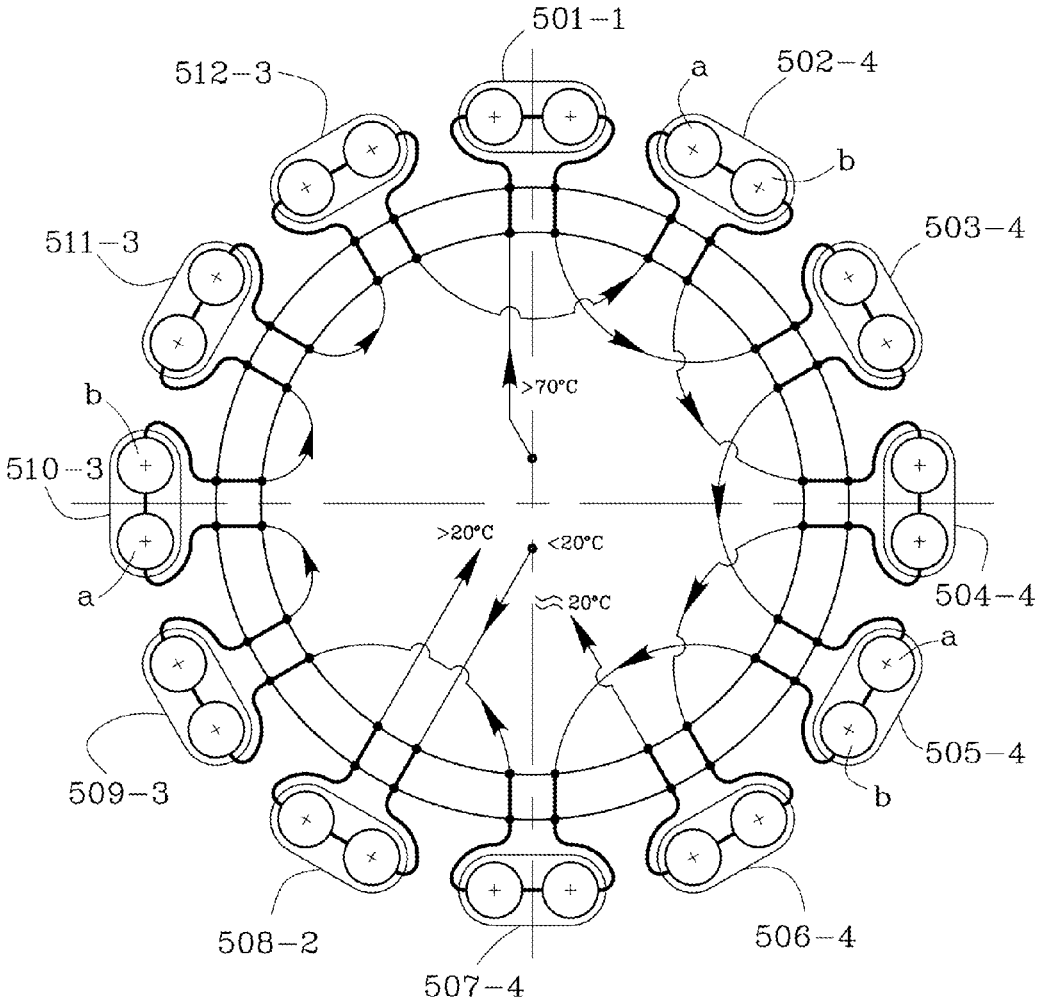
Figure 6:
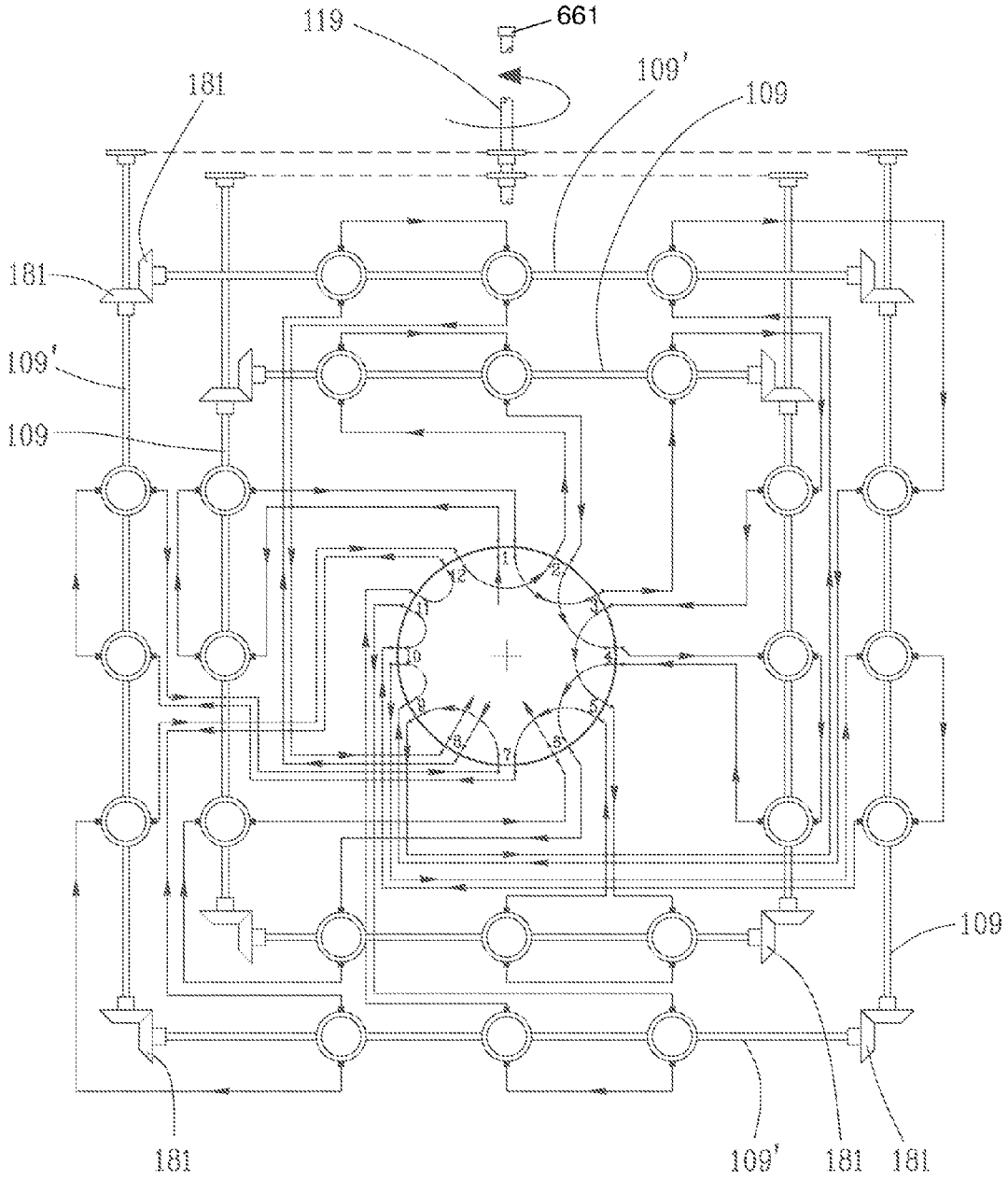
Figure 7:
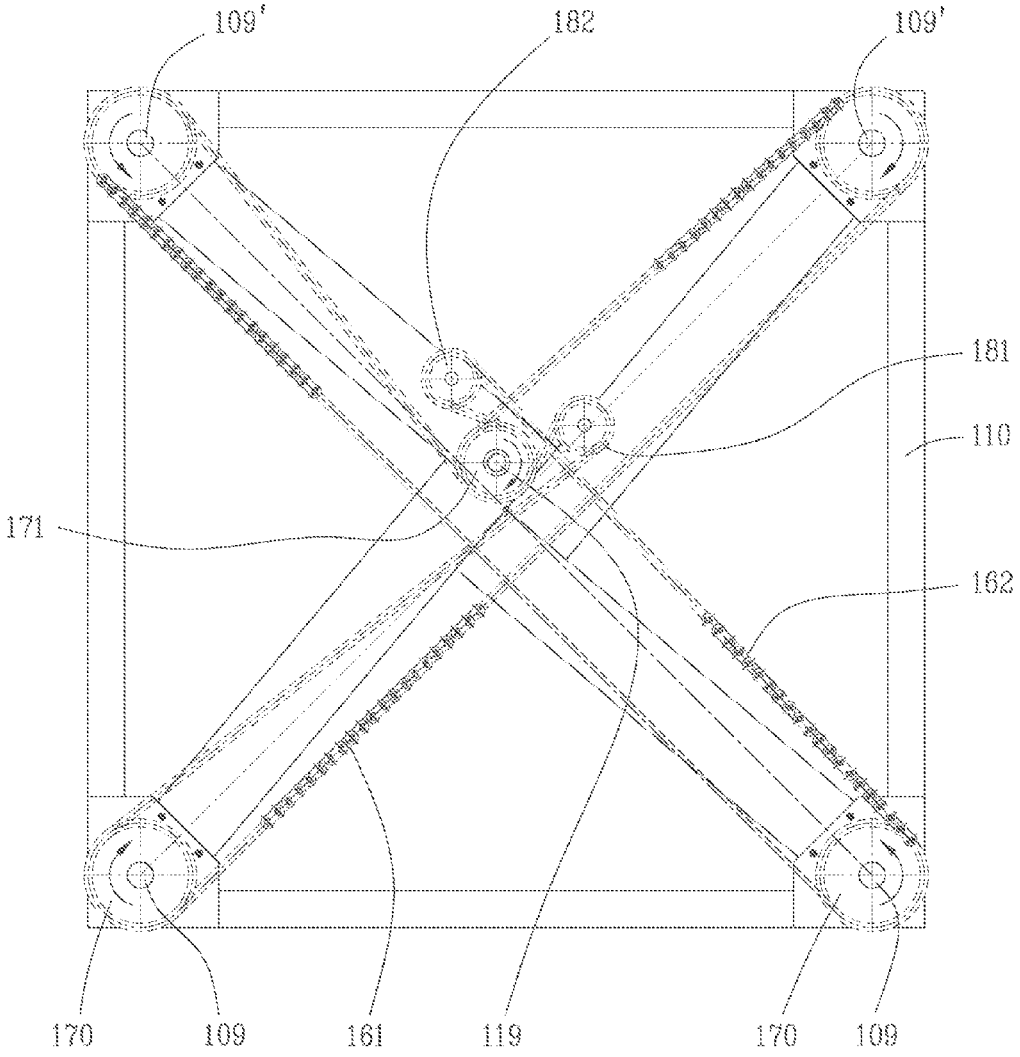
Figure 8A:
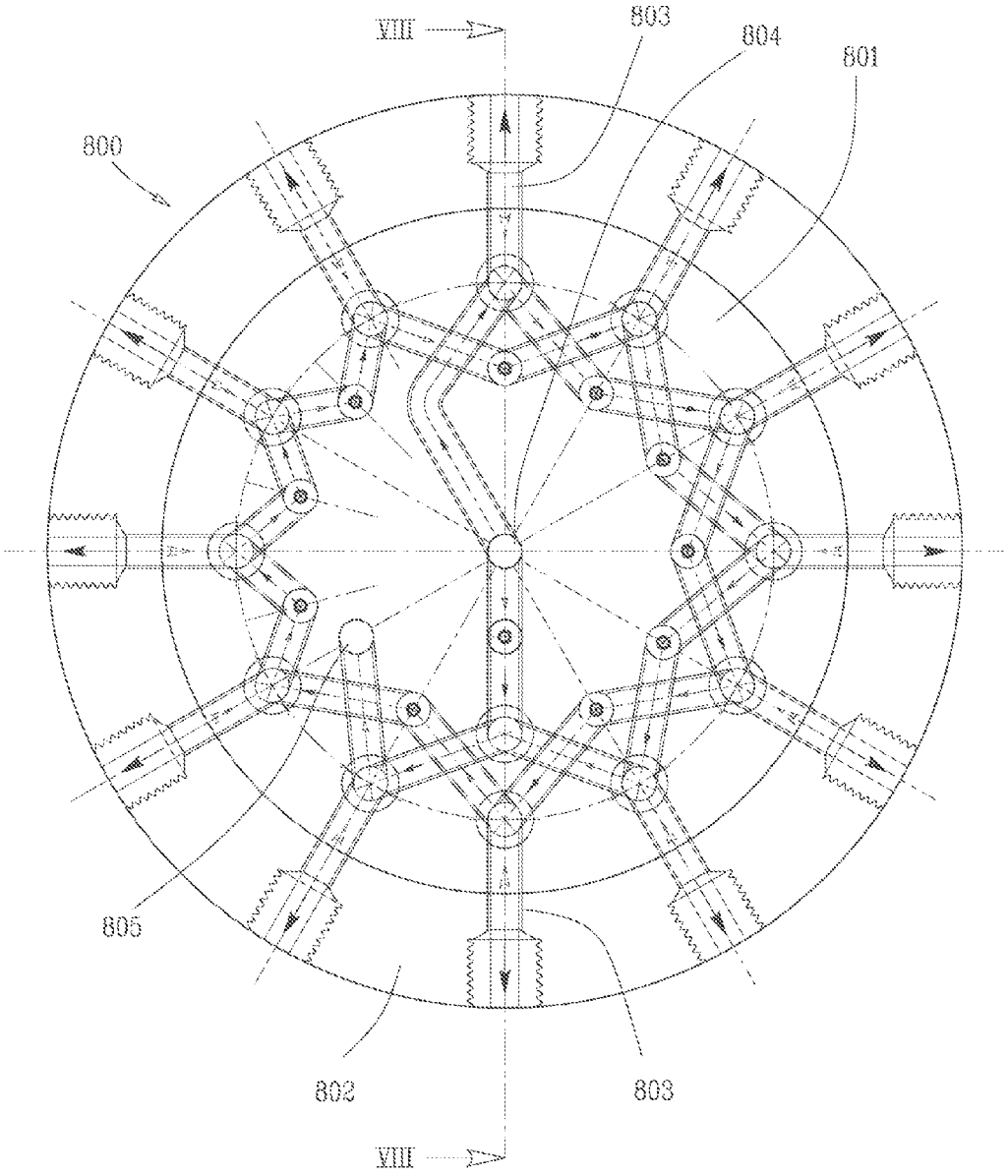
Figure 8B:
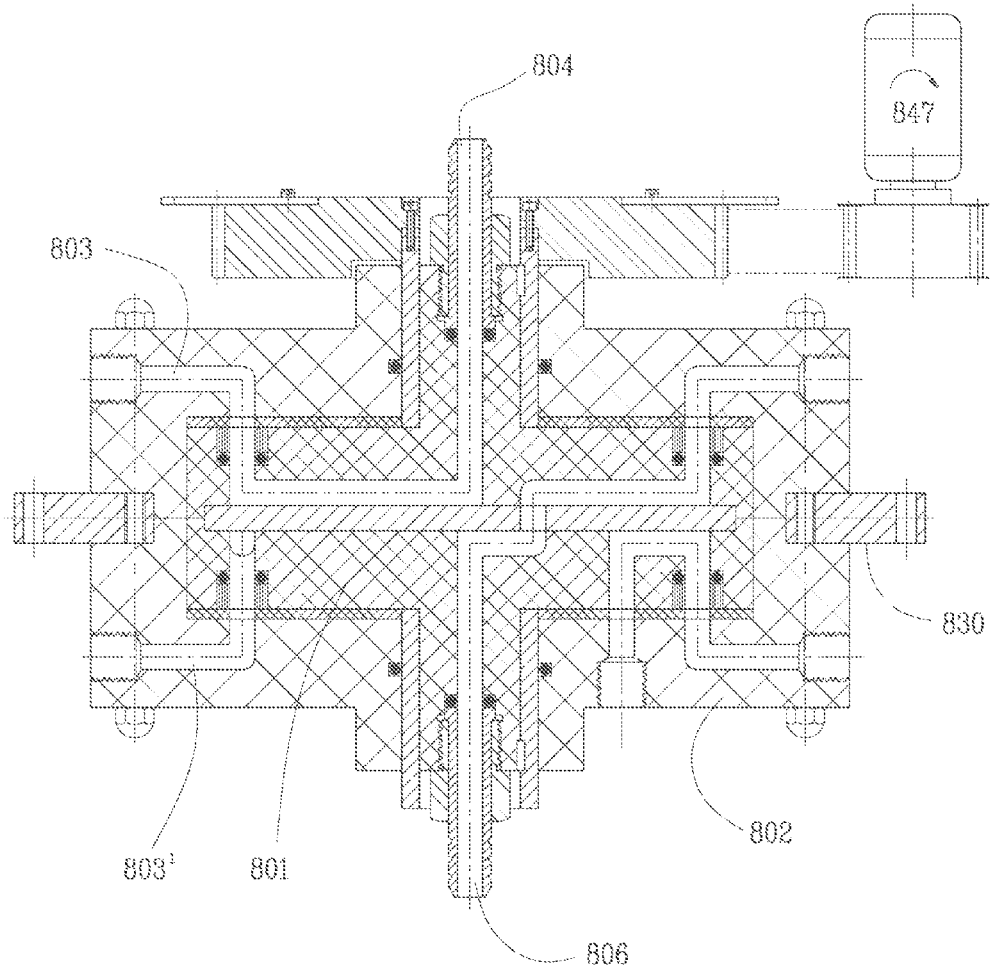
Figure 9:
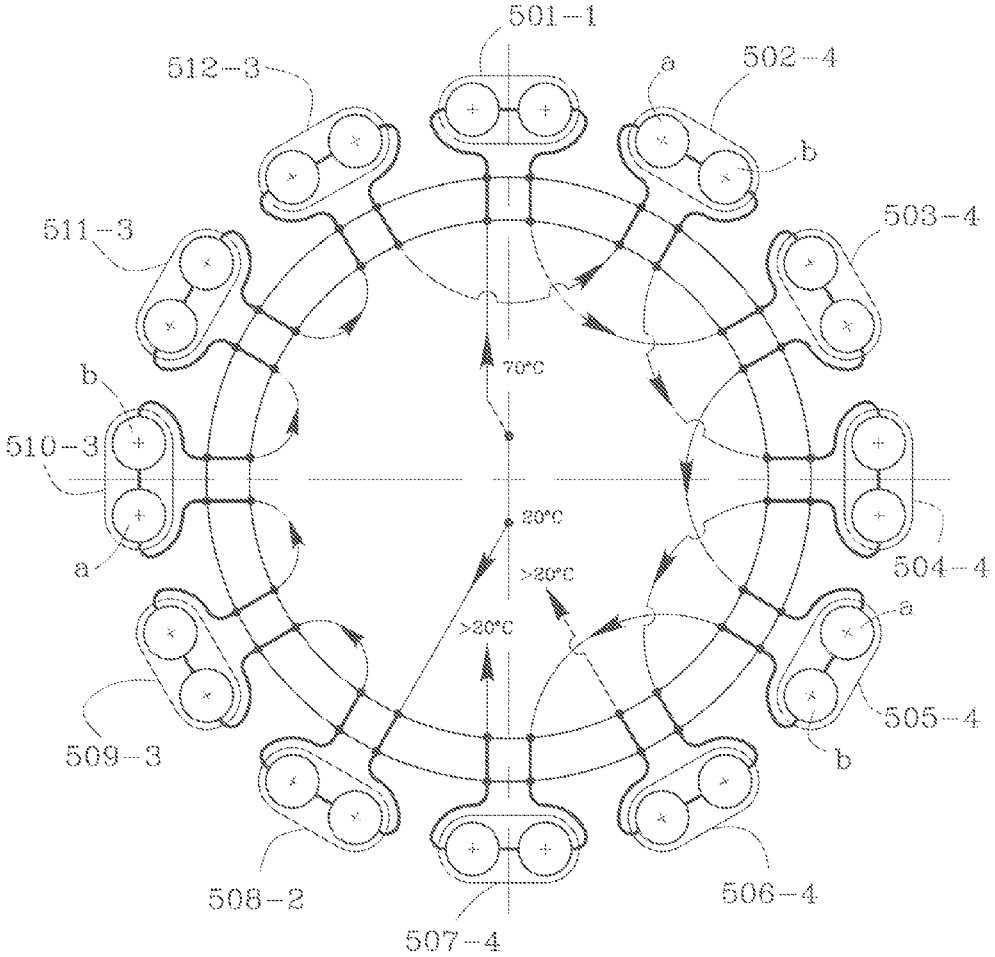

FIG. 4*a-c* show a schematic arrangement of 12 chamber units each at a different phase in a thermal heating/cooling cycle of working medium in the chamber units;

FIG. 5 shows a schematic bottom view of the chamber units and the way in which they are connected for a first way of operating;

FIG. 6 shows a detail of a realized embodiment of the apparatus according to the present invention (top view), with 4 ancillary axles;

FIG. 7 shows a front view of the apparatus, ancillary axles being coupled via chains to drive an outgoing shaft;

FIG. 8*a* shows a cross-sectional view through a multiway-valve for controlling the flow of heat exchange medium through an apparatus according to the invention;

FIG. 8*b* shows a cross-sectional view through the multiway-valve of FIG. 8 along line VIII-VIII; and FIG. 9 shows a variant of the schematic bottom view of the chamber units of FIG. 5 and the way in which they are connected for an alternative way of operating.

Figure 1A:
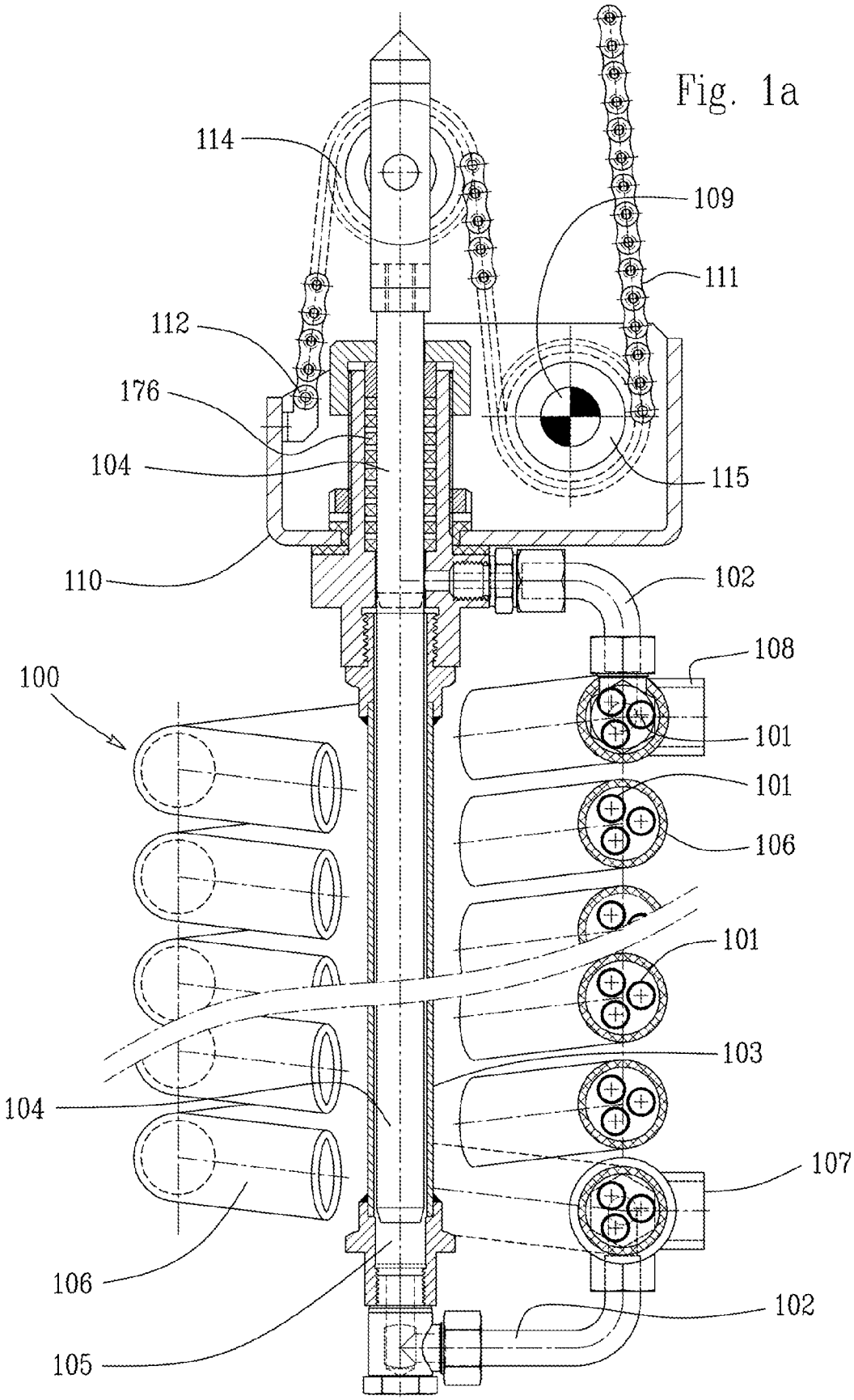
Figure 1B:
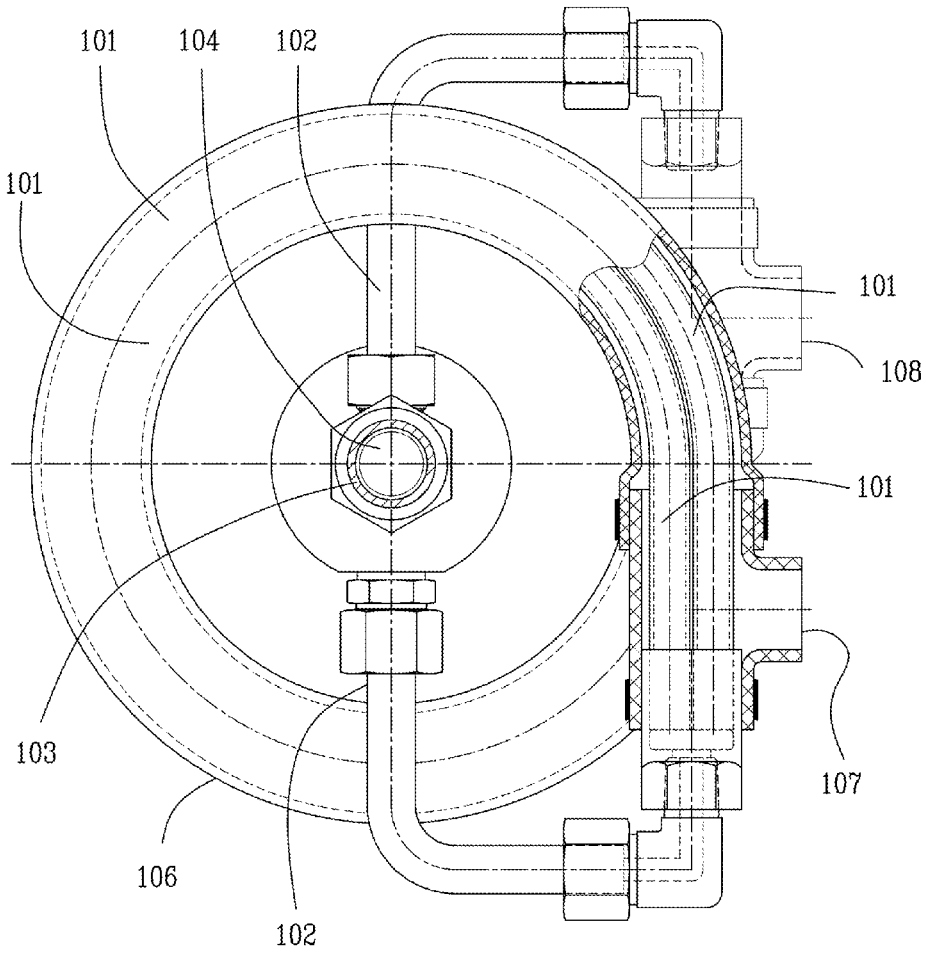

FIG. 1*a* shows a chamber unit 100 comprising three copper tubes 101 having a circular cross-section and having two common ends 102. The chamber unit 100 is provided with a cylinder 103 which is provided with a piston 104. FIG. 1*b* shows the chamber unit 100 of FIG. 1*a* in a partially cut-away bottom view.

The copper tubes 101 are enclosed in a second tube 106, here in the form of a plastic hose, having an inlet 107 for a heat exchange medium and an outlet 108 for said heat exchange medium. The heat exchange medium will generally be water, but may be of a different composition.

Figure 2:
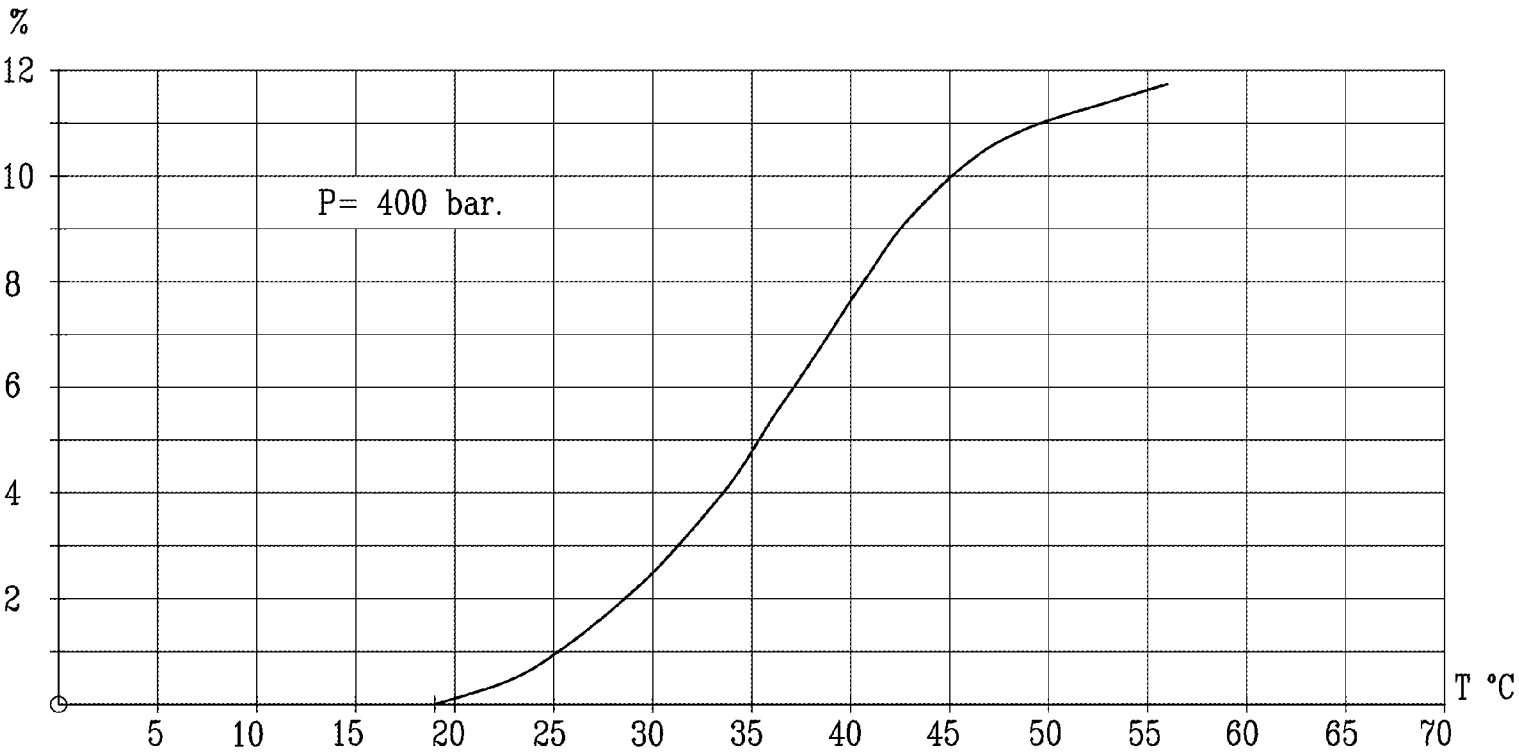
FIG. 2 is a graph showing super expansion behaviour of a paraffin suitable for use in the method and in the apparatus according to the invention.

The copper tubes 101, the cylinder 103 and the piston 104 define a closed chamber 105, which contains a working medium displaying super expansion. An example of a suitable working medium is paraffin VP858 (Sasol, Hamburg, Germany). To prevent the working medium from escaping from the closed chamber 105, sealing rings 176 are provided, Teflon sealing against the piston 104. FIG. 2 shows the expansion behaviour of this paraffin depending on the temperature. It is clear that over a limited temperature range the paraffin displays an exceptionally large expansion, and this range is particularly suitable for converting thermal energy into mechanical energy.

The copper tubes 101 will serve as a heat exchanging wall for transfer of heat between the heat exchange medium passed through the second tube 106 and the working medium present inside the closed chamber 105. Although it is feasible if one end 102 of a copper tube 101 is closed, for the best operation, both ends 102 of copper tube 101 open into the cylinder 103.

It is noted that in use, the working medium inside the closed chamber 105 will be at a high pressure when heated, typically hundreds of bars. For this reason, it is preferred that the second tube 106 encompasses the first tube 101 instead of the other way around. While copper is a preferred material because it is a very good thermal conductor, it should be noted that the tube 101 is subjected to large forces. For this reason, in case use is made of copper for the tube 101, high grade copper will be used. Suitable copper tube is commercially available, such as copper tube xyz available from Wieland (Ulm, Germany).

If the working medium inside the closed chamber 105 is relatively cold and the heat exchange medium passed through the second tube 106 is relatively warm, the piston 104 will move from a relatively retracted position inside the cylinder 103 (corresponding to the relatively retracted state shown in FIG. 1*a*) to a relatively extended position. Very large forces can be exerted by the piston 104 during this movement. If the piston 104 moves in the opposite direction because the working medium is relatively warm and the heat exchange medium is relatively cold, the piston 104 is not capable of performing any useful work because it would result in a negative pressure inside the closed chamber 105.

Figure 3:
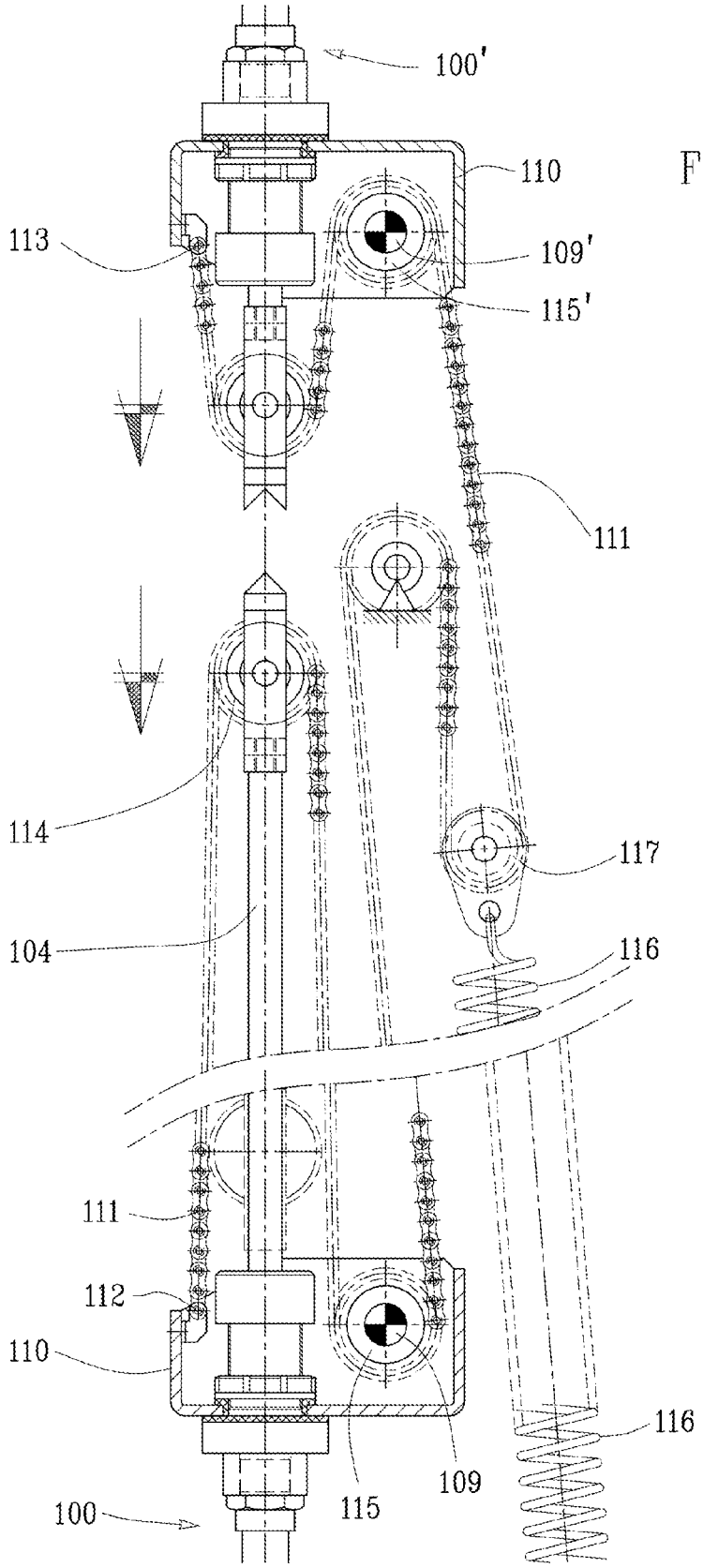
FIG. 3 shows a chamber unit workably connected to an axle.

FIG. 3 shows a frame 110 with two identical but facing chamber units 100, 100' (partially shown), and will be used to show how a force exerted by a piston 104 may be transferred to an ancillary axle 109. In FIG. 3, parts of chamber unit 100 don't have an apostrophe, whereas their counterparts of chamber unit 100' do. The chamber units 100, 100' are attached to the frame 110. A chain 111 having two ends 112 and 113 respectively is connected with said ends 112, 113 to the frame 110. The piston 104 is provided at its distal (protruding) end with a sprocket 114 and the ancillary axle 109 is provided with a freewheel sprocket 115. The chain 111 passes over the sprocket 114 and the freewheel sprocket 115. If the piston 104 extends, the chain 111 drives the ancillary axle 109 in a first rotational direction, whereas if the piston 104 retracts, the freewheel sprocket 115 allows the chain to move with respect to the ancillary axle 109 without driving said ancillary axle 109 in a direction opposite to the first rotational direction.

The linear movement of the piston 104 is thus converted into a rotational movement of the ancillary axle 109. If there were only one piston 104 to drive an ancillary axle 109, the conversion of thermal energy into mechanical energy would not result continuous output of mechanical energy. For this reason the method according to the invention makes use of a multitude of chamber units driven with a different phase, achieved by passing heat exchange medium of different temperatures through the chamber units at any given time. In FIG. 3, the chamber unit 100' driving ancillary axle 109' is at a 180° difference in phase with respect to chamber unit 100 driving ancillary axle 109, but particular ancillary axle will be driven with different (intermediate) phase differences as well. That is, a multitude of chamber units 100 operated with a different phase is used to drive ancillary axle 109, using respective pistons 104 with sprockets 114. Similarly, a multitude of chamber units 100' will be used to drive ancillary axle 109'.

It is noted that a peculiarity of the apparatus is that the pressure in closed chambers of chamber units actually driving a common ancillary axle will be the same, even though they don't have the same phase. The actual pressure is dependent on several factors, amongst which the load at the outgoing shaft. Because there will be multiple fourth chamber units, this results in smooth operation and a first chamber unit having extended its piston maximally can stop contributing mechanical energy and a second chamber unit can kick in as a fourth chamber unit without causing shock effects.

A spring 116 with a sprocket 117, the spring 116 being attached to the frame 110, is used to keep the chain 111 taut. In case of a phase difference of 180° between chamber units 100 and 100' (as is preferred), there will hardly be any movement of the sprocket 117 during continuous operation, and the spring 116 will serve mainly to keep the chain 111 taut from start-up (when the working medium in the chambers chamber units 100, 100' is cold and the distal ends of opposing pistons are further apart).

An important aspect of the present invention is that once working medium inside a chamber unit 100 is heated by heat exchange medium, this heat is recuperated to a large extent for subsequent heating of relatively cool working medium. This involves the use of a multitude of third chamber units 100, and the distribution of heat exchange medium through the second tubes 106 of said chamber units 100, as will be explained in greater detail below.

Figure 4:
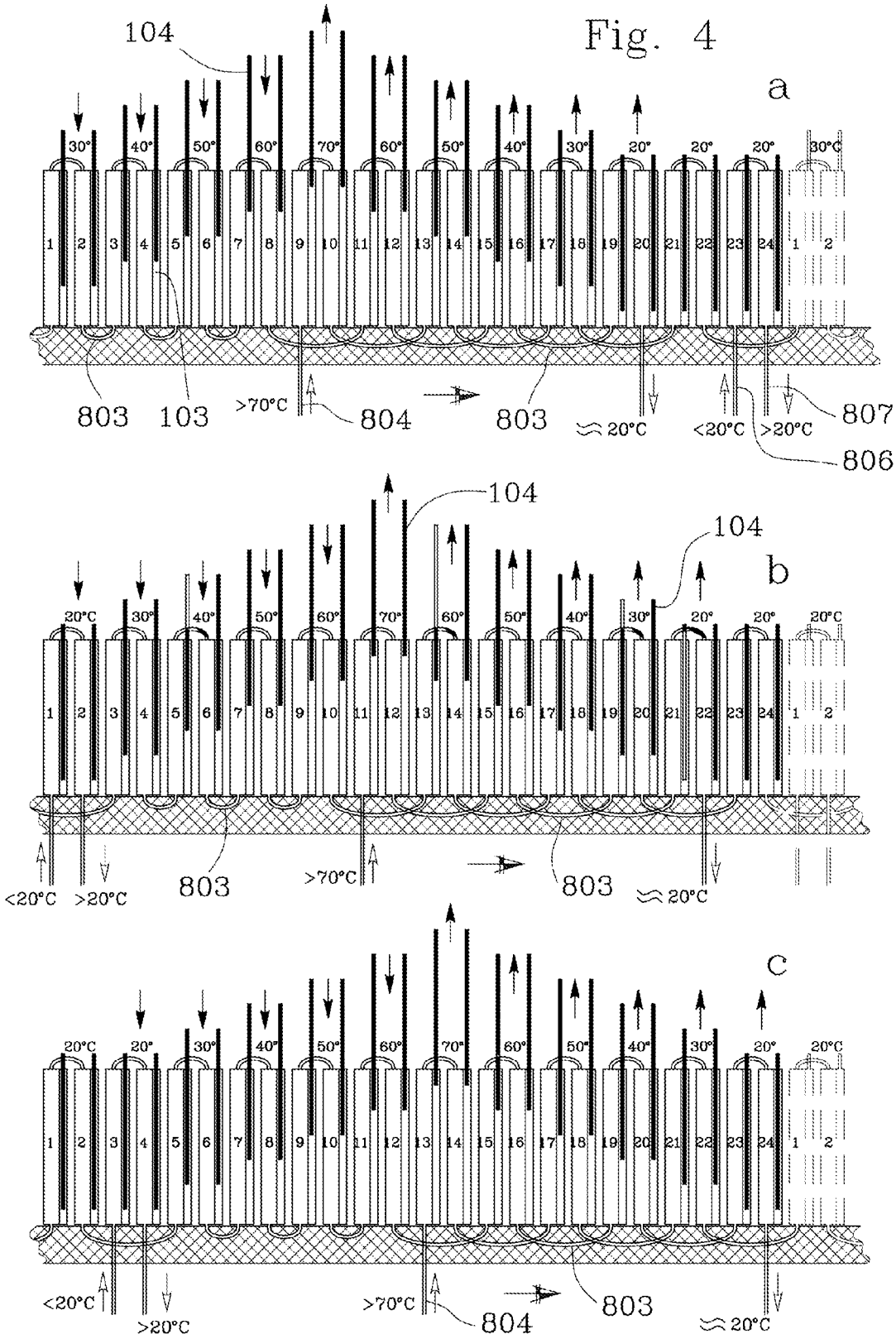

FIG. 4*a-c* show a schematic arrangement of 24 chamber units 100 operated in 12 groups of 2 chamber units, each group at a different phase in a thermal heating/cooling cycle of working medium in the chamber units 100. Accordingly, the pistons 104 of the chamber units 100 extend from the cylinders 103 of the chamber units over different lengths. Arrows indicate the direction of movement of the pistons 104. Thus by using multiple chamber units operating at different phases mechanical energy can be delivered in a continuous manner. It is remarked that of a group of 2 chamber units, one chamber unit could contain a first working medium and the other chamber unit could contain another working medium having a superexpansion range differing from but overlapping with the super expansion range of the first working unit. This allows for a larger working temperature range (albeit at the cost of reduced efficiency at converting heat into mechanical energy). FIG. 4 shows channels 803, inlets 804, 806 and outlets 804 which are discussed with reference to FIG. 8*a* below.

Once the temperature of the working medium in a chamber unit is comparable to the temperature of the heat exchange medium with which it is exchanging heat, the flow of heat exchange medium through the chamber units is changed so as to cause the working medium to contract or expand.

There are two major ways of operating, both of which will be explained below.

According to the first major way of operating, a relatively hot heat exchange medium, usually hot water, of a first temperature is introduced into the inlet 107 of a (first) chamber unit 100 to heat already relatively warm working medium. After heat exchange, the heat exchange medium is passed to another (fourth) chamber unit containing relatively cool working medium to heat that relatively cool working medium. This is preferably repeated one or more times, so the already somewhat cooler heat exchange medium is used to heat working medium of a (fourth) chamber unit 100 that is relatively cool. This results in heat exchange medium that has given off most of its thermal energy, and work has been performed by the respective (fourth) chamber units 100. The heat exchange medium that was cooled off is now used to recuperate thermal energy from working medium inside a (third) chamber unit 100 that is relatively warm compared to the heat exchange medium of a third temperature. Once warmed up a bit, the heat exchange medium is passed to yet another (third) chamber unit 100 etc, until the heat exchange medium is hot enough to heat working medium inside a fourth chamber 100, and preferably several fourth chambers having working medium of different temperatures so as to use the thermal energy of the heat exchange medium to perform work and to result in relatively cool heat exchange medium, which is subsequently discharged.

To make sure that heat exchange medium can heat working medium even if the heat exchange medium isn't very warm, the working medium inside one of the chamber units 100 (the second chamber unit) is cooled, and some thermal energy is lost here.

This embodiment is in particular suitable where it is desired to extract thermal energy to a large extent, e.g. in case a heat storage is present. A practical example is a building provided with solar panels for collecting heat during the day, storing the heat in a buffer and generating electricity at any desired time by depleting the buffer.

To explain the flow of heat exchange medium for a specific embodiment, reference is made to FIG. 5, which is bottom view of an arrangement of 12 chamber units 100. A top view would show a similar arrangement of 12 chamber units 100'. The latter arrangement is operated similarly as will now discussed for the arrangement of chamber units 100. The temperatures of heat exchange medium (water) and working medium (paraffin) are merely given for explanatory purposes.

FIG. 5 shows one first chamber unit 501-1, six fourth chamber units 502-4 through 507-4, one second chamber unit 508-2 and four third chamber units 509-3 through 512-3. The fourth chamber units come in three pairs:

502-4 and 503-4 constitute the first pair;

504-4 and 505-4 constitute the second pair; and

506-4 and 507-4 constitute the third pair.

Of the first pair, the working medium of 502-4 is warmer than the working medium of 503-4.

Of the second pair, the working medium of 504-4 is warmer than the working medium of 505-4.

Of the third pair, the working medium of 506-4 is warmer than the working medium of 507-4.

Hot heat exchange medium, e.g. hot water that would normally have to be disposed of, e.g. using a cooling tower, of a temperature of over 70° C. is introduced into the first chamber unit 501-1. There it heats the working medium to the highest temperature working medium reaches in the thermal cycle described here, 70° C. During this heat exchange process, the heat exchange medium cools down a bit, and it is passed to the fourth chamber unit 503-4 where it heats the working medium to 50° C. Having given off more heat, the heat exchange medium has become colder yet again and is now used to heat working medium of fourth chamber unit 505-4 to 30° C. From there, the heat exchange medium is passed to heat the working medium of fourth chamber unit 507-4. This working medium of fourth chamber unit 507-4 had previously been cooled using cold water of <20° (when the fourth chamber unit currently designated 505-4 was second chamber unit 508-2).

Now the relatively cool heat exchange medium from unit 507-4 of a third low temperature is used to recuperate heat from third chamber units 509-3 through 512-3 consecutively, resulting in warmed up heat exchange medium that is passed to the fourth chamber unit 502-4 to heat its working medium. From the fourth chamber unit 502-4, the heat exchange medium is used to heat the working media of the fourth chamber units 504-4 and 506-4 respectively, before being discharged, for example in another buffer, or discharged on surface water. According to a highly preferred embodiment, however, the water is reheated, e.g. using solar energy or geothermal energy, to >70° for heating the first chamber unit 501-1.

In the apparatus actually built a chamber unit as discussed above was actually composed of two chamber units a, b operated as a single chamber unit. The drawing reflects this, but the design choice was made because of the parts available to the inventor. The apparatus was able to convert heat into work with an efficiency of over 20%.

FIG. 6 schematically shows the actually realized embodiment of the present invention (top view), with 4 ancillary axles 109 for chamber units 100. The ancillary axles 109 are coupled via conical gear wheels 181. To allow FIG. 6 to show both the ancillary axles 109 of the lower half of the apparatus and the ancillary axles 109' of the upper half of the apparatus, the former have been drawn shorter.

FIG. 7 shows a front view of an apparatus according to the invention. Ancillary axles 109, 109' are workably linked to an outgoing shaft 119. FIG. 7 (where the chamber units are left out) shows the frame 110 and the ends of four, parallel ancillary axles 109, 109'. These ancillary axles 109, 109' are provided with sprockets 170 and drive the outgoing shaft 119, provided with two sprockets 171 (they are behind each other, so only one is indicated) via chains 161, 162 (one chain for each sprocket 171 of the outgoing shaft 119). Two ancillary sprockets 181, 182 are provided for tensioning the chains 161, 162 respectively.

With the method and apparatus according to the present invention, the working medium is not moved from one chamber unit to another but remains where it is. The thermal cycle involves that chamber units have different roles at different times in the thermal cycle. They are first, third, second and fourth chamber units in turn. This requires the stream of heat exchange medium to be fed to a chamber unit to be controlled accordingly. According to a favourable embodiment, this may be done with a multiple-way valve as is shown in FIGS. 8*a* and 8*b* in a cross-sectional view. A first circular section 801 is rotated with respect to a stationary section 802. The stationary section 802 contains a multitude of channels 803, 803' connected to the inlets 107 and outlets 108 of the chamber units via tubing 106 (visible in FIG. 1*a*). The first circular section 801 defines a path that corresponds to the desired distribution pattern for heat exchange medium as shown in FIG. 5. The first section 801 has an inlet 804 for hot heat exchange medium to be passed to first chamber unit 501-1 and an outlet 805 for discharging the exhausted heat exchange medium from fourth chamber unit 506-4. There is also an inlet 806 for passing cooling heat exchange medium through the second chamber unit 508-2 and an outlet 807 for discharging the cooling heat exchange medium. This may be in a closed loop, e.g. if a liquid-air heat exchanger is provided.

In operation, the first circular section is discontinuously rotated using a motor 847 (FIG. 8*b*). During the actual rotation, the flow of heat exchange medium will be interrupted so as to reduce the likelihood of leakage of heat exchange medium. Once the inlets 804 and outlets 805 are aligned with the channels 803, 803', the feeding of heat exchange medium is resumed.

It should be noted that for the best performance, the flow of heat exchange medium through the chamber units 100 should be controlled with respect to volume and time. If the working medium doesn't heat up sufficiently, the duration and/or volume of heat exchange medium should be increased. If the energy conversion efficiency drops, the duration and/or volume of heat exchange medium should be reduced.

Again reference is made to FIG. 4 shows the channel arrangement of FIG. 8*a* in a schematic linear lay-out.

The second major way of operating uses heat exchange medium in a closed loop. Heat exchange medium is simply passed from one chamber unit to the next. However, between the chamber unit and the next, the heat exchange medium can be diverted to one of two heat exchangers. If the next chamber unit is to serve as a second chamber unit, the heat exchange medium is passed to a heat exchanger which is cooled. If the next chamber unit is to serve as a first chamber unit, the heat exchange medium is passed to a heat exchanger which is heated. To keep the heat exchange medium flowing, a pump will be provided.

Apart from the difference in heat exchange medium distribution indicated, the actual apparatus may otherwise be identical or substantially similar to the embodiment discussed in FIGS. 1*a*, 1*b*, 3, 6 and 7, and does not require further elucidation.

FIG. 9 shows a variant of the schematic bottom view of the chamber units of FIG. 5 and the way in which they are connected for an alternative way of operating. Cooled down heat exchange medium from the fourth chamber units 506-4 and 507-4 is discharged from these units, and may be passed to a heat exchanger (not shown) to be cooled, releasing the extracted heat to the environment, and resulting in fresh cooling heat exchange medium. The second chamber unit 508-2 is cooled with said fresh cooling heat exchange medium. The advantage of this method of operation is that it is easier to ensure that the non-gaseous working medium (paraffin) has contracted to the desired extent, allowing more work to be done in the fourth chamber units.

The invention may be varied within the scope of the enclosed independent claims. For example:

the cylinder of a chamber unit does not necessarily have to be at an end, but may for example be in the middle (T-shaped chamber). In fact, having multiple tubes connected to the chamber is an excellent opportunity to scale-up the apparatus according to the invention;

in the second major embodiment, the heat exchange medium itself may be subjected to heat exchange for heating and/or cooling, and passed to the first chamber unit and second chamber unit respectively before being passed to the fourth chamber unit and third chamber unit respectively. This is most easily accomplished using a multiway-valve in which at one side of the first circular part there is a centrally located inlet for heated heat exchange medium and an outlet for heat exchange medium to be heated, and at the opposite side of the first circular part there is a centrally located inlet for cooled heat exchange medium and an outlet for heat exchange medium to be cooled. A pair of inlet and outlet may be concentrically placed. With a proper (insulating) choice of material and by keeping the parallel length short, this has little effect on the energy efficiency of the apparatus. The invention is also very suitable for the conversion of earth-derived heat (terrestrial heat/geothermal heat), which is currently financial less attractive because the length of the holes that have to be drilled in the earth is not primarily determined by the amount of heat that can be extracted but by the temperature level required to be of any use. Thanks to the device and method according to the present invention, a large saving can be realized because boreholes can be much shorter.

The invention claimed is:

1. A method of converting thermal energy into mechanical energy using a non-gaseous working medium present in an apparatus comprising a plurality of heat exchangers and an outgoing shaft, characterized in that the apparatus comprises a multitude of chamber units, each chamber unit comprising an inlet for introducing heat exchange medium and an outlet for the discharging heat exchange medium as well as a closed chamber having a heat exchanger wall for exchanging heat between working medium inside the closed chamber and the heat exchange medium introduced into the chamber unit via said inlet for introducing the heat exchange medium;

the closed chambers of the chamber units comprise a cylinder and a piston, wherein the piston of a closed chamber is workably connected to the outgoing shaft, the outgoing shaft being workably driven by the piston if the piston is moved from a first, relatively retracted position in the cylinder to a second, relatively protruding position and free movement of the outgoing shaft is allowed if said piston is moved from the second to the first position;

wherein the heat exchange medium having a first, high temperature is used for heating working medium present in a first chamber unit for driving the outgoing shaft;

the heat exchange medium having a second, low temperature is used for cooling working medium in a second chamber unit;

relatively cool heat exchange medium having a third temperature between the first and the second temperature is introduced via the inlet of a third chamber unit comprising relatively warm working medium to yield warmed-up heat exchange medium;

relatively warm heat exchange medium having a fourth temperature between the first and the second temperature is introduced via the inlet of a fourth chamber unit comprising relatively cool working medium to heat the working medium and drive the outgoing shaft;

wherein after being heated by the heat exchange medium of the first temperature, the first chamber unit is used as a third chamber unit so as to extract thermal energy from said third chamber unit to result in warmed-up heat exchange medium;

after being cooled by the heat exchange medium of the second temperature, the second chamber unit is used as a fourth chamber unit to be warmed by relatively warm heat exchange medium of a fourth temperature;

after being cooled down by relatively cool heat exchange medium of a third temperature, the third chamber unit is used as a second chamber unit; and after being warmed by relatively warm heat exchange medium of a fourth temperature the fourth chamber unit is used as the first chamber unit.

2. The method according to claim 1, wherein there is at least one pair of the fourth chamber units, the first of the pair of fourth chamber units comprising working medium at a relatively high temperature compared to the temperature of the working medium in the second of said pair of fourth chamber units, wherein the second of said pair of fourth chamber units is heated using the heat exchange medium discharged from the first chamber unit after heat exchange with said first chamber unit; and the first of said pair of fourth chamber units is heated using relatively warm heat exchange medium discharged from a third chamber unit that has a temperature of the working medium closest to the temperature of the working medium of the first chamber unit.

3. The method according to claim 1, wherein the outgoing shaft is connected to a generator for generating electricity.

4. The method according to claim 1, wherein the apparatus comprises a second working medium, the working medium and the second working medium differing in super expansion range.

5. The method according to claim 1, wherein the heat exchange medium is heated using solar energy.

6. The method according to claim 2, wherein there is at least a second pair of fourth chamber units, the first chamber unit of said second pair of fourth chamber units comprising the working medium at a relatively high temperature compared to the temperature of the working medium in the second chamber unit of said second pair of fourth chamber units, and cooled down heat exchange medium from the first chamber unit of the pair of fourth chamber units is used to heat the first chamber unit of said second pair of fourth chamber units and cooled down heat exchange medium from the second chamber unit of the first pair of fourth chamber units is used to heat the second chamber unit of said second pair of fourth chamber units.

7. The method according to claim 6, wherein cooled-down heat exchange medium from the first chamber unit of the last pair of fourth chamber units is discharged from the apparatus and the loss of heat exchange medium being compensated by the heat exchange medium having the first temperature introduced in the first chamber unit; and the cooled-down heat exchange medium from the second chamber unit of the last pair of fourth chamber units is used as relatively cool heat exchange medium to cool working medium in a third chamber unit having a working medium temperature closest to the working temperature of the second chamber unit.

8. An apparatus for converting thermal energy into mechanical energy using a non-gaseous working medium, the apparatus comprising a plurality of heat exchangers and an outgoing shaft, characterized in that the apparatus comprises a multitude of chamber units, each of the multitude of chamber units comprising an inlet for introducing heat exchange medium and an outlet for discharging said heat exchange medium after having undergone heat exchange as well as a closed chamber having a heat exchanger wall for exchanging heat between working medium inside the closed chamber and the heat exchange medium introduced into the chamber unit via said inlet for introducing heat exchange medium;

the closed chambers comprising a cylinder and a piston, the piston of a closed chamber being workably connected to the outgoing shaft via an organ capable of driving the outgoing shaft if the piston is moved from a first, relatively retracted position in the cylinder to a second, relatively protruding position for driving the outgoing shaft and allowing free movement of the outgoing shaft if said piston is moved from the second to the first position;

the apparatus comprises a device for distributing a heat exchange medium for passing said heat exchange medium along the heat exchanger walls via said inlets and outlets of the chamber units, the device being capable of providing a first chamber unit with heat exchange medium of a first high temperature and providing a second chamber unit with heat exchange medium with a second low temperature, providing a third chamber unit with heat exchange medium of a third temperature between the first and the second temperature and providing a fourth chamber unit with heat exchange medium of a fourth temperature between the first and the second temperature.

9. The apparatus according to claim 8, wherein the outgoing shaft is connected to a generator for generating electricity.

10. The apparatus according to claim 8, wherein the apparatus comprises a control device for starting and stopping the flow of the heat exchange medium through at least one of the chamber units.

11. The apparatus according to claim 8, wherein the organ comprises a freewheel.

12. The apparatus according to claim 11, wherein the piston of a chamber unit is provided with a sprocket, the apparatus comprises a frame and a chain, a first end of the chain being attached to the frame and the chain from that first end being passed over said sprocket and subsequently over the freewheel.

13. The apparatus according to claim 12, wherein the piston of a third chamber unit is aligned opposite to a piston of a fourth chamber unit, the second, remaining end of the chain being attached to the frame as well and the third and fourth chamber units each having their own sprocket and freewheel but sharing the chain, the apparatus being provided with a tensioning organ for keeping the chain taut.

14. The apparatus according to claim 8, wherein the device for distributing heat exchange medium over the chamber units comprises a first member and a second member, the first member being rotatable relative to the second member around an axis of rotation in a first direction, the first member comprising a multitude of through channels, each of said through channels connecting two surface areas of said first member and suitable for passing heat exchange medium to and from the chamber units and the second member comprising a conduit arrangement, wherein for every chamber unit of the multitude of chamber units the first member comprises at least a first channel for passing heat exchange medium to a chamber unit and at least one second channel for heat exchange medium passed through said chamber unit; the first channel having an inlet end facing the second member and an outlet end not facing the second member; the second channel having an outlet end facing the second member and an inlet end not facing the second member, the inlet ends of the first channels being distributed evenly spaced over the circumference of a circle having its center on the axis of rotation and the outlet ends of the second channels being distributed evenly spaced over the circumference of a second circle having its center on the axis of rotation;

the conduit arrangement of the second member comprises a multitude of through channels, the through channels having inlets for sealingly connecting to the outlets of second channels of the first member and to an inlet for heat exchange medium of the first high temperature and to an inlet for heat exchange medium of a second low temperature, and outlets for sealingly connecting to the inlets of first channels of the first member, and an outlet for discharging heat exchange medium from the apparatus;

said inlets of the second member being distributed over the first circle and said outlets of the second member being distributed over the second circle, and the through channel of the second member being capable of connecting the outlet of a second channel of the first member connected to a particular chamber unit with the inlet of a first channel of the first member connected to a different chamber unit.

15. A method of converting thermal energy into mechanical energy using a non-gaseous working medium, comprising:

providing a conversion apparatus comprising:

at least four chamber units, each of the four chamber units having an inlet for introducing heat exchange medium and an outlet for discharging the heat exchange medium as well as a closed chamber having a heat exchanger wall for exchanging heat between working medium inside the closed chamber and the heat exchange medium, the closed chambers of the chamber units having a cylinder and a piston; and an outgoing shaft workably connected to the piston of each of the closed chamber, the outgoing shaft being workably driven by the piston when the piston extends, with free movement of the outgoing shaft being allowed when the piston retracts in the cylinder; and driving the outgoing shaft by using the four chamber units in four stages, with each of the chamber unit of the four chamber units in a different one of the four stages at any given time, and using hot heat exchange medium from a hot heat exchange medium source and cold heat exchange medium from a cold heat exchange medium source, the four stages comprising:

a first stage of introducing cooled-down heat exchange medium into the chamber unit, the cooled-down heat exchange medium having been output from a second stage of a different chamber unit, the cooled-down heat exchange medium having a temperature between the temperature of the hot heat exchange medium source and the temperature of the cold heat exchange medium source;

the second stage of heating working medium present in the chamber unit with the heat exchange medium from the hot heat exchange medium source, the second stage outputting the cooled-down heat exchange medium, the first and second stages collectively driving the outgoing shaft;

a third stage of introducing warmed-up heat exchange medium into the chamber unit, the warmed-up heat exchange medium having been output from a fourth stage of a different chamber unit, the warmed-up heat exchange medium having a temperature between the temperature of the hot heat exchange medium source and the temperature of the cold heat exchange medium source; and the fourth stage of cooling working medium present in the chamber unit with the heat exchange medium from the cold heat exchange medium source, the fourth stage outputting the warmed-up heat exchange medium.

* * * * *